US007830202B2

(12) United States Patent
Chen et al.

(10) Patent No.: US 7,830,202 B2
(45) Date of Patent: Nov. 9, 2010

(54) CURRENT MIRROR CIRCUIT

(75) Inventors: Kai-Ji Chen, Sinshih Township, Tainan County (TW); Shin-Wen Gu, Sinshih Township, Tainan County (TW)

(73) Assignee: Himax Analogic, Inc. (TW)

( * ) Notice: Subject to any disclaimer, the term of this patent is extended or adjusted under 35 U.S.C. 154(b) by 438 days.

(21) Appl. No.: 12/099,757

(22) Filed: Apr. 8, 2008

(65) Prior Publication Data

US 2009/0153126 A1 Jun. 18, 2009

(30) Foreign Application Priority Data

Dec. 18, 2007 (TW) ..... 96148492 A

(51) Int. Cl.
*G05F 3/02* (2006.01)

(52) U.S. Cl. ..... 327/543; 323/315

(58) Field of Classification Search ..... 323/282–288, 323/312–316; 327/280, 281, 307, 317, 308, 327/530, 535, 541–543; 330/261
See application file for complete search history.

(56) References Cited

U.S. PATENT DOCUMENTS

| | | | | |
|---|---|---|---|---|
| 3,975,648 | A * | 8/1976 | Tobey et al. | 327/543 |
| 4,399,399 | A * | 8/1983 | Joseph | 323/315 |
| 5,666,046 | A * | 9/1997 | Mietus | 323/313 |
| 6,181,195 | B1 * | 1/2001 | McIntyre | 327/538 |
| 6,838,916 | B2 * | 1/2005 | Premont et al. | 327/132 |

* cited by examiner

*Primary Examiner*—Rajnikant B Patel
(74) *Attorney, Agent, or Firm*—Hayes Soloway P.C.

(57) ABSTRACT

The present invention discloses a current mirror circuit generating an output current flowing through an output current path according to an input current flowing through an input current path. The current mirror circuit comprises a P type transistor in the output current path, an operational amplifier, and a basic circuit. The operational amplifier has a negative input coupled to a node receiving the input current, a positive input coupled to a drain of the P type transistor, and an output coupled to a gate of the P type transistor. The basic circuit comprises a first transistor in the input current path and a second transistor in the output current path. The first transistor has a gate and a drain coupled together. The second transistor has a gate coupled to the gate of the first transistor.

11 Claims, 6 Drawing Sheets

CURRENT MIRROR CIRCUIT

RELATED APPLICATIONS

This application claims priority to Taiwan Application Serial Number 96148492, filed Dec. 18, 2007, which is herein incorporated by reference.

FIELD OF THE INVENTION

This invention relates to a current mirror circuit, and more particularly, to an accurately matched current mirror circuit.

BACKGROUND OF THE INVENTION

FIG. 1 shows a conventional current mirror circuit. The conventional current mirror circuit includes transistors M1, M2 and M3. The transistor M1 carries the reference current Ii while the second transistor M2 carries the output current Io. The transistors M1 and M2 have gates coupled together in order to ensure they have identical gate-source voltages so that the reference current Ii is mirrored to the output current Io, i.e., the current Io flowing in the channel of the transistor M2 is proportional to the reference current Ii.

FIG. 2 shows another conventional current mirror circuit which is often referred to as a cascode current mirror. The cascoded transistors are arranged in series to the first transistor M1 and the second transistor M2. Similar to the circuit shown in FIG. 1, identical gate-source voltages on the transistors result in the reference current Ii being mirrored to the output current Io. However, when the drain voltage is higher than a threshold voltage, the current will flow from the drain to the substrate directly rather than through the channel. This is the so-called "hot carrier" effect. The substrate current resulting from "hot carrier" effect under high drain-to-source voltages leads to current mismatch between the input and output current.

In order to solve the current mismatch issue, circuits shown in FIG. 3 and FIG. 4 are proposed. An NMOS transistor M6 and operational amplifier 302 are included in the circuit of FIG. 3. However, the substrate current of the transistor M6 still causes the mismatch between the reference current Ii and the output current Io. In the circuit of FIG. 4, two NMOS transistors M7 and M8 are included so that the drain voltages of the transistors M1 and M2 are kept close to each other. However, the current leakage in the transistors M7 and M8 still results in current mismatch. Furthermore, the need for the bias voltages Va and Vb complicates the circuit design.

SUMMARY OF THE INVENTION

Therefore, an aspect of the present invention is to provide a current mirror circuit in which a P type transistor is included in the output current path to achieve better resistance to the hot carrier effect.

Another objective of the present invention is to provide a current mirror circuit in which a bulk and the source of the P type transistor are connected together to achieve better resistance to the hot carrier effect.

Still another objective of the present invention is to provide a current mirror circuit in which an operational amplifier is included to achieve current match between the input and output path.

In order to achieve the aforementioned aspects, the present invention provides a current mirror circuit generating an output current flowing through an output current path according to an input current flowing through an input current path. The current mirror circuit comprises a P type transistor, an operational amplifier, and a basic circuit. The P type transistor is located in the output current path. The operational amplifier has a negative input coupled to a node receiving the input current, a positive input coupled to a drain of the P type transistor, and an output coupled to a gate of the P type transistor. The basic circuit comprises a first transistor and a second transistor. The first transistor is located in the input current path and the first transistor has a gate and a drain coupled together. The second transistor is located in the output current path and the second transistor has a gate coupled to the gate of the first transistor.

According to the embodiment of the present invention, the aspect ratios of the first transistor and the second transistor are substantially the same. The source and a bulk of the P type transistor are coupled together.

To achieve the aforementioned aspects, the present invention provides another current mirror circuit generating an output current flowing through an output current path according to an input current flowing through an input current path. The current mirror circuit comprises a first transistor, an operational amplifier, a basic circuit, and an auxiliary circuit. The first transistor is located in the output current path. The operational amplifier has a negative input coupled to a node receiving the input current, a positive input coupled to a drain of the first transistor, and an output coupled to a gate of the first transistor. The basic circuit comprises a second transistor and a third transistor. The second transistor is located in the input current path and the second transistor has a gate and a drain coupled together. The third transistor is located in the output current path and the third transistor has a gate coupled to the gate of the second transistor. The auxiliary circuit is located in at least one of the input and output current path for improving a performance of the current mirror.

According to the embodiment of the present invention, the auxiliary circuit comprises at least a fourth transistor in the input current path and at least a fifth transistor in the output current path. The second, third, fourth and fifth transistors are coupled to constitute a cascode structure. The fourth transistor has a gate and a drain coupled together, and the fifth transistor has a gate coupled to the gate of the fourth transistor. The aspect ratios of the second transistor and the third transistor are substantially the same. The source and a bulk of the first transistor are coupled together. The first transistor is a P type transistor.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
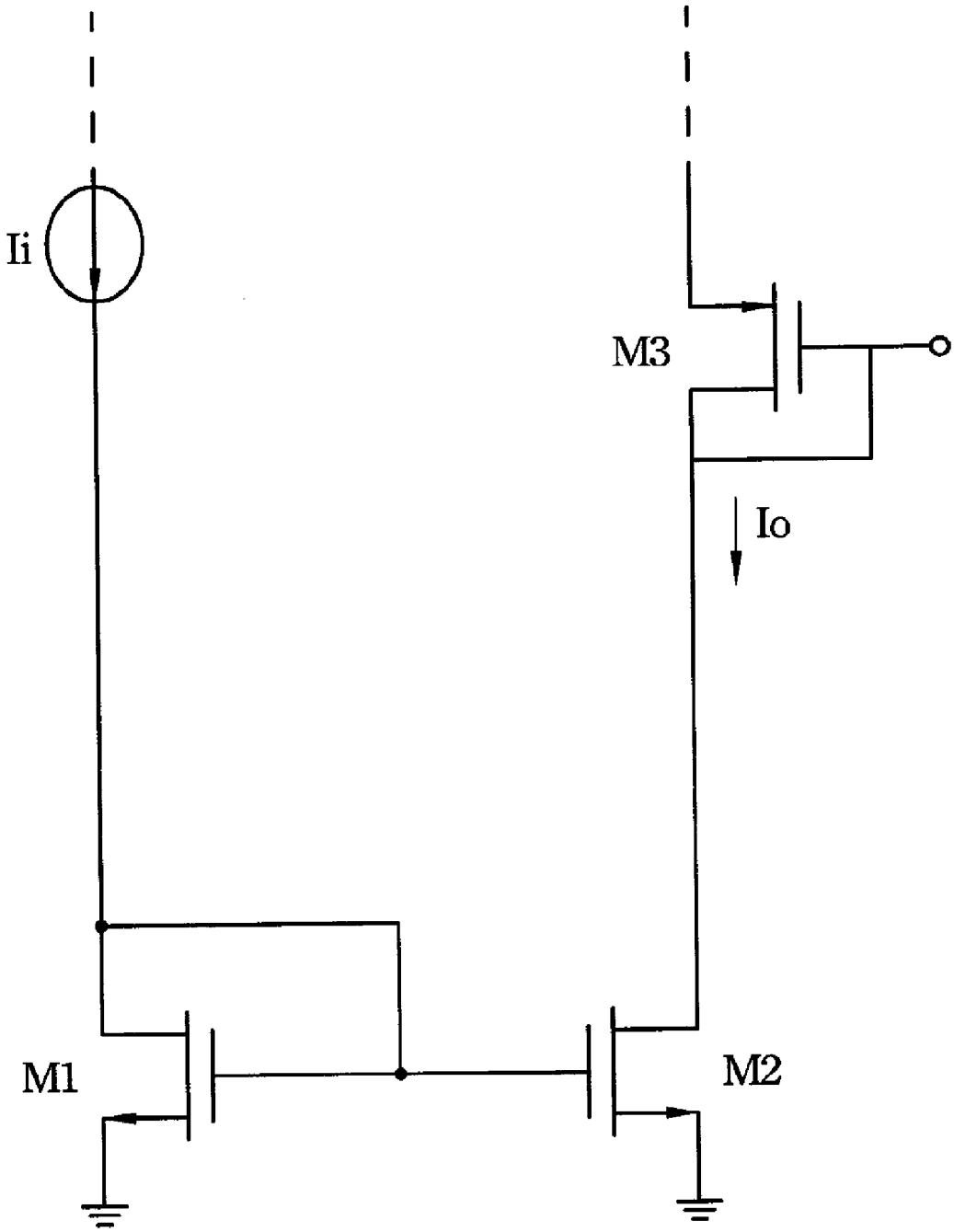
Fig. 1 (Prior Art)
FIG. 1 shows a first conventional current mirror circuit.
Figure 2:
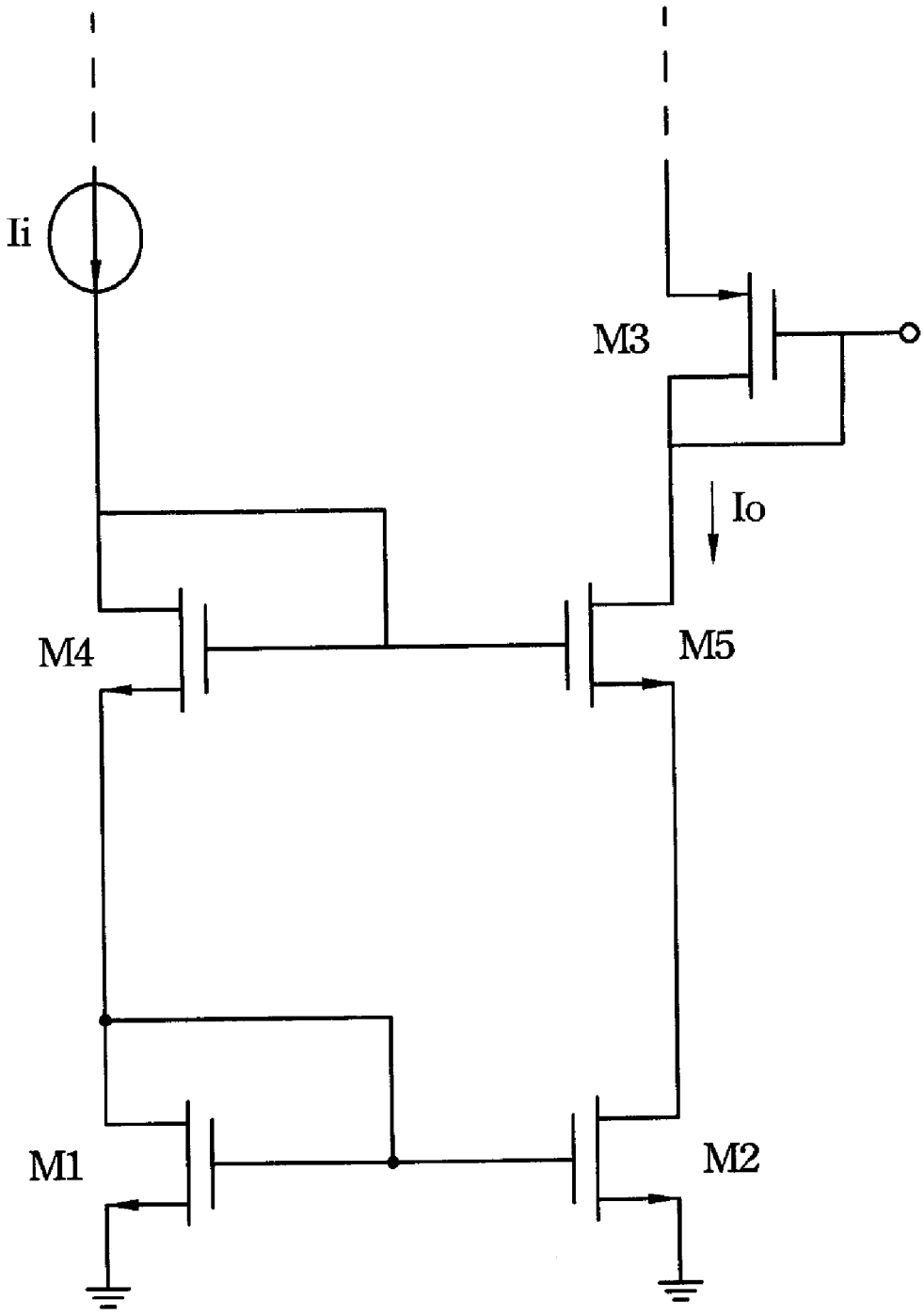
Fig. 2 (Prior Art)
FIG. 2 shows a second conventional current mirror circuit.
Figure 3:
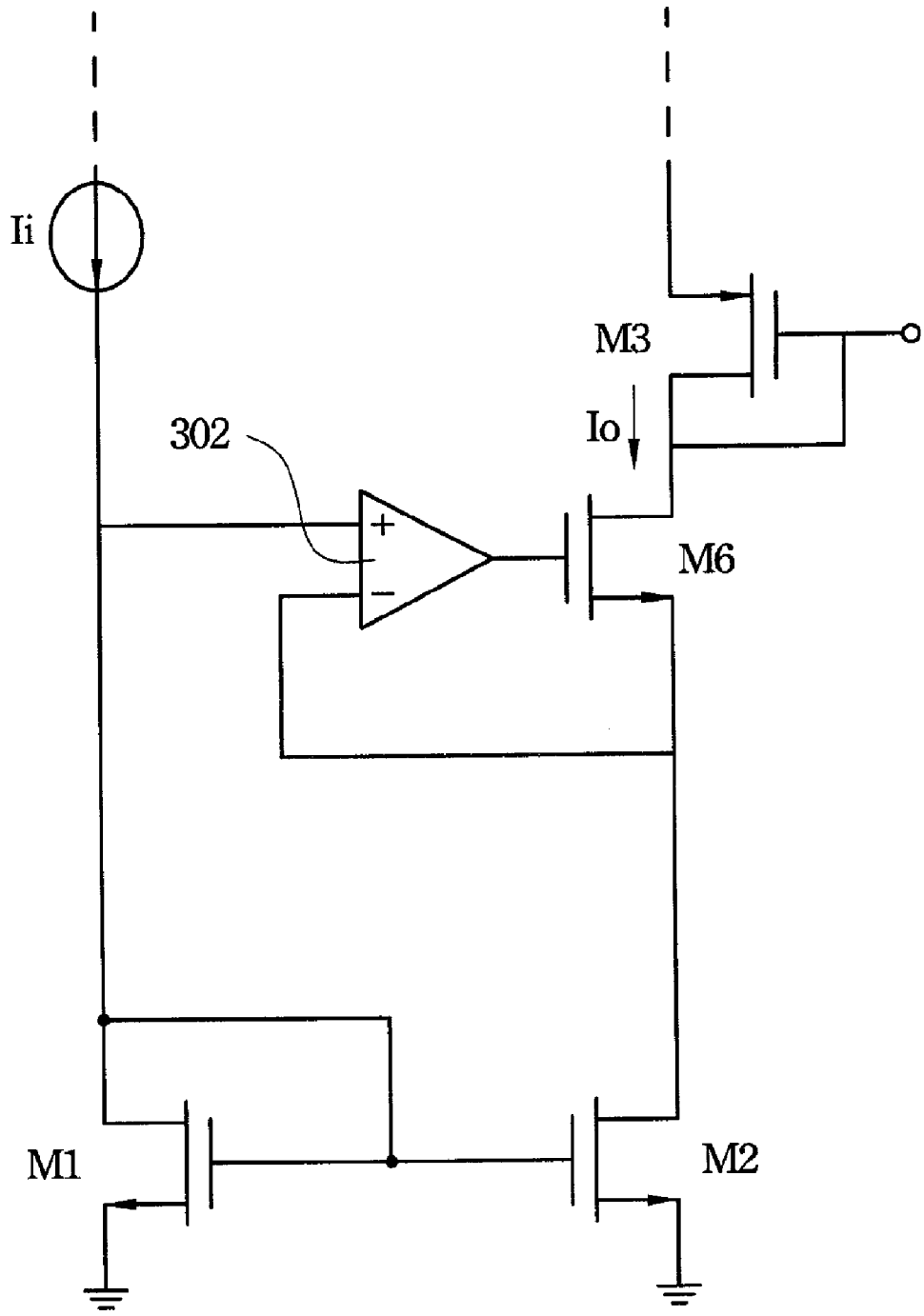
Fig. 3 (Prior Art)
FIG. 3 shows a third conventional current mirror circuit.
Figure 4:
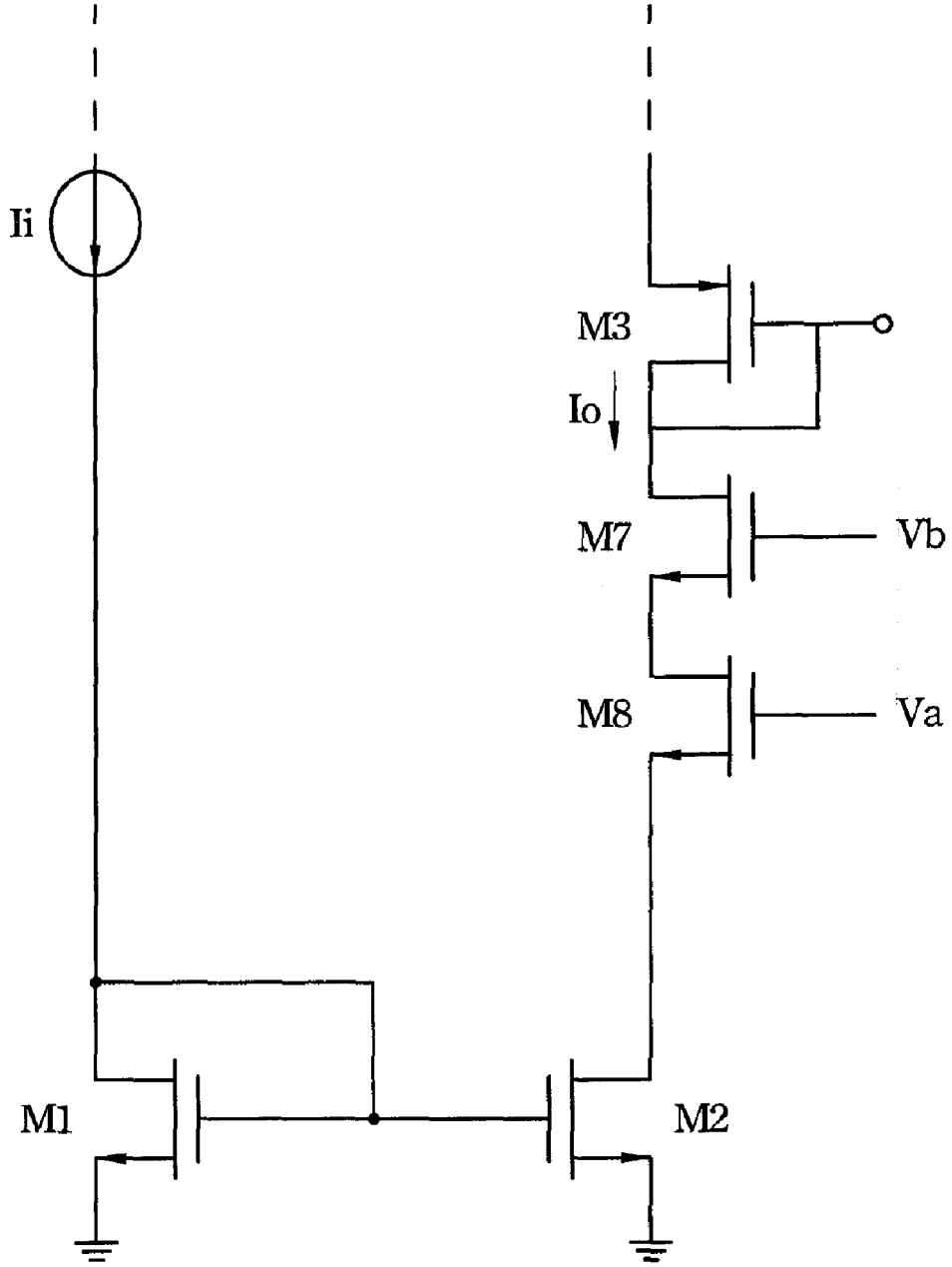
Fig. 4 (Prior Art)
FIG. 4 shows a fourth conventional current mirror circuit.
Figure 5:
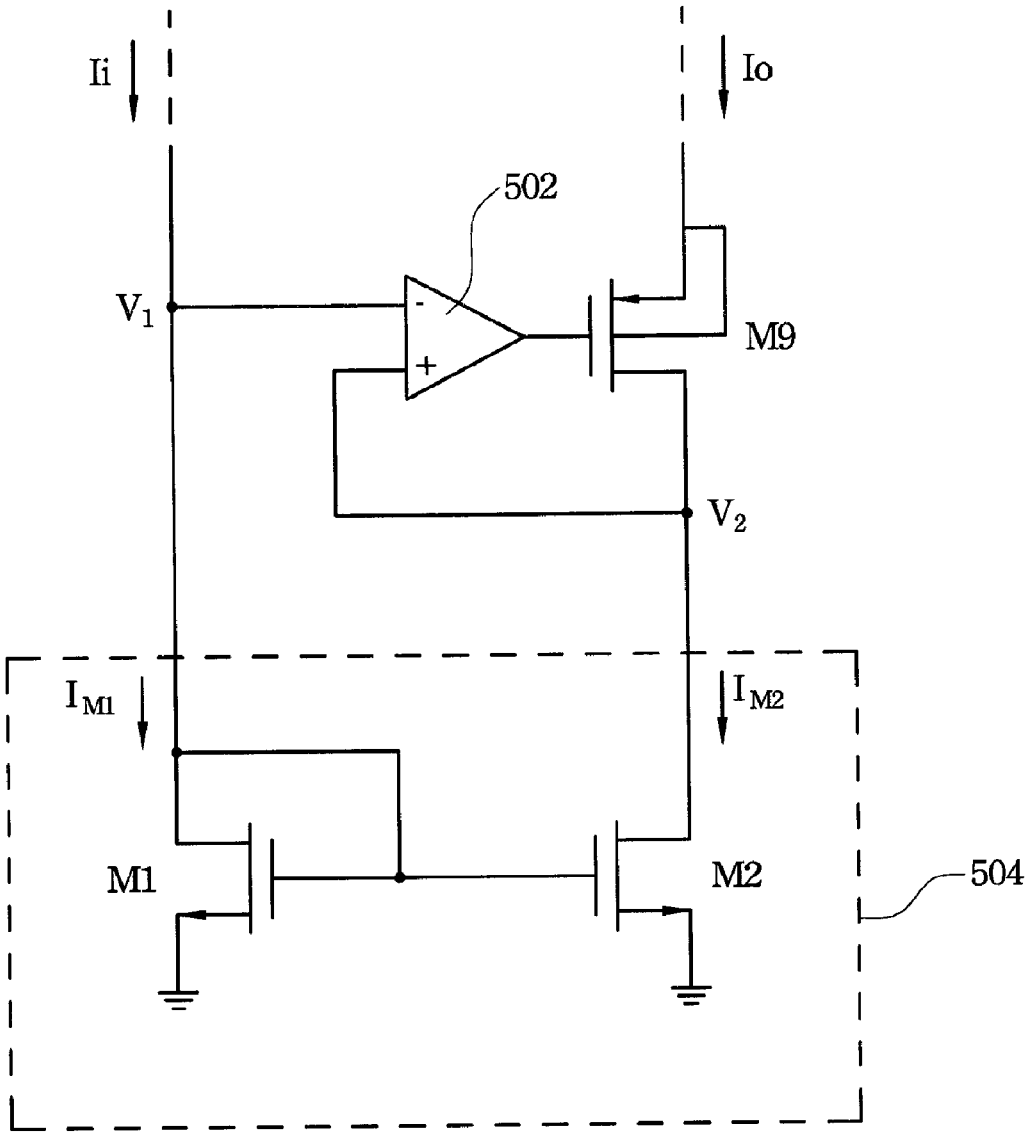
FIG. 5 shows a current mirror circuit according to a preferred embodiment of the present invention.
Figure 6:
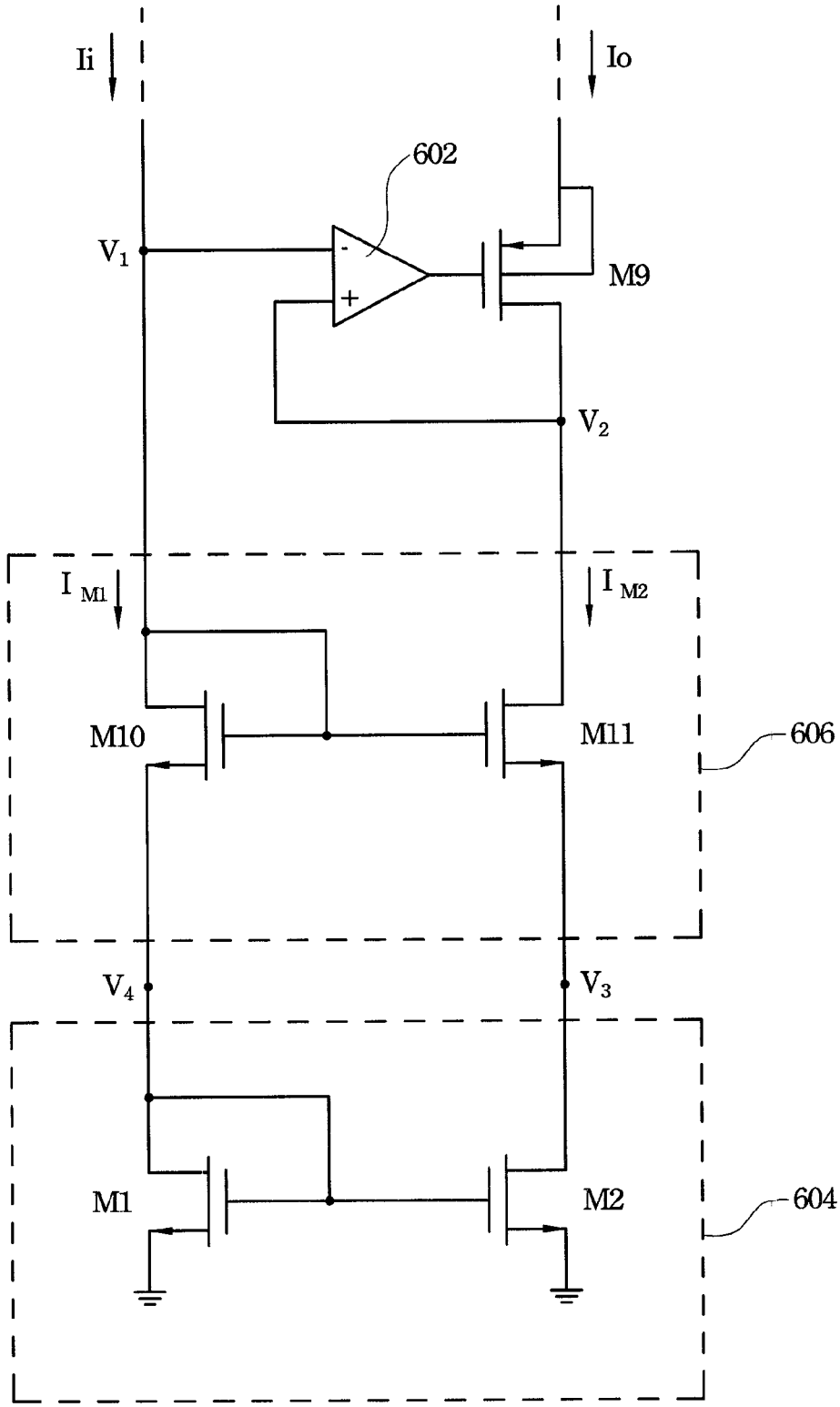
FIG. 6 shows a current mirror circuit according to another preferred embodiment of the present invention.

In order to make the illustration of the present invention more explicit and complete, the following description is stated with reference to FIGS. 5 through 6.

FIG. 5 shows a current mirror circuit according to a preferred embodiment of the present invention. The current mirror circuit generates an output current Io flowing through an output current path according to an input current Ii flowing through an input current path. The current mirror circuit includes a PMOS transistor M9, an operational amplifier 502 and a basic circuit 504. The PMOS transistor M9 is located in the output current path. The source and a bulk of the PMOS transistor M9 are coupled together. The operational amplifier 502 has a negative input coupled to a node V1 receiving the input current Ii, a positive input coupled to a drain of the PMOS transistor M9 at a node V2, and an output coupled to a gate of the PMOS transistor M9. The basic circuit 504 includes a transistor M1 in the input current path and a transistor M2 in the output current path. The transistor M1 has a gate and a drain coupled together, and the transistor M2 has a gate coupled to the gate of the transistor M1. The aspect ratios of the transistor M1 and the transistor M2 are substantially the same.

Since the input ends of the operational amplifier 502 are virtually connected, the voltages at the nodes V1 and V2 are the same. Thus, the current $I_{M2}$ flowing through the transistor M2 is equal to the current $I_{M1}$ flowing through the transistor M1. Due to no current flowing into the operational amplifier 502, the current $I_{M1}$ is equal to the current Ii and therefore the current $I_{M2}$ is also equal to the current Ii. Furthermore, since holes have better resistance to the "hot carrier" effect than electrons do, the current Io is equal to the current $I_{M2}$ even though the PMOS transistor M9 located in the output current path may experience high $V_{DS}$. Consequently, the input current Ii flowing through the input current path is equal to the output current Io flowing through the output current path. The current mismatch issue in the conventional current mirror circuit is eliminated.

FIG. 6 shows a current mirror circuit according to another preferred embodiment of the present invention. The current mirror circuit generates an output current Io flowing through an output current path according to an input current Ii flowing through an input current path. The current mirror circuit includes a transistor M9, an operational amplifier 602, a basic circuit 604 and an auxiliary circuit 606. The transistor M9 is located in the output current path and is a P type transistor. The source and a bulk of the transistor M1 are coupled together. The operational amplifier 602 has a negative input coupled to a node V1 receiving the input current Ii, a positive input coupled to a drain of the transistor M9 at a node V2, and an output coupled to a gate of the transistor M9. The basic circuit 604 includes a transistor M1 in the input current path and a transistor M2 in the output current path. The transistor M1 has a gate and a drain coupled together. The transistor M2 has a gate coupled to the gate of the transistor M1. The aspect ratios of the transistor M1 and M2 are substantially the same.

The auxiliary circuit 606 is located in at least one of the input and output current path for improving a performance of the current mirror. The auxiliary circuit 606 includes a transistor M10 in the input current path and a transistor M11 in the output current path. The transistors M1, M2, M10 and M11 are coupled to constitute a cascode structure. The transistor M10 has a gate and a drain coupled together, and the transistor M11 has a gate coupled to the gate of the transistor M10.

The voltage at V3 equals to the voltage at V4 due to the cascode structure. Furthermore, as mentioned above, the voltages at V1 and V2 are the same, and both the currents $I_{M1}$ and $I_{M2}$ are equal to the current Ii. Since holes have better resistance to the "hot carrier" effect than electrons do, the current Io is equal to the current $I_{M2}$ even though the PMOS transistor M9 located in the output current path may experience high $V_{DS}$. Consequently, the input current Ii flowing through the input current path is equal to the output current Io flowing through the output current path. The current mismatch issue in the conventional current mirror circuit is eliminated.

According to the aforementioned description, one advantage of the present invention is that a P type transistor is used in the output current path and the bulk and the source of the P type transistor are connected together to achieve better resistance to the hot carrier effect.

According to the aforementioned description, yet another advantage of the present invention is that an operational amplifier is included to achieve current match between the input and output path.

As is understood by a person skilled in the art, the foregoing preferred embodiments of the present invention are strengths of the present invention rather than limiting of the present invention. It is intended to cover various modifications and similar arrangements included within the spirit and scope of the appended claims, the scope of which should be accorded the broadest interpretation so as to encompass all such modifications and similar structure.

What is claimed is:

1. A current mirror circuit generating an output current flowing through an output current path according to an input current flowing through an input current path, comprising:

a P type transistor in the output current path;

an operational amplifier having a negative input coupled to a first node receiving the input current, a positive input coupled to a drain of the P type transistor, and an output coupled to a gate of the P type transistor; and a basic circuit comprising:

a first transistor in the input current path, the first transistor having a gate and a drain coupled together; and a second transistor in the output current path, the second transistor having a gate coupled to the gate of the first transistor.

2. The current mirror circuit as claimed in claim 1, wherein aspect ratios of the first transistor and the second transistor are substantially the same.

3. The current mirror circuit as claimed in claim 1, wherein the source and a bulk of the P type transistor are coupled together.

4. The current mirror circuit as claimed in claim 1, further comprising an auxiliary circuit in at least one of the input and output current path for improving a performance of the current mirror.

5. The current mirror circuit as claimed in claim 4, wherein the auxiliary circuit comprises:

a third transistor in the input current path, having a gate and a drain coupled together; and a fourth transistor in the output current path, having a gate coupled to the gate of the third transistor.

6. A current mirror circuit generating an output current flowing through an output current path according to an input current flowing through an input current path, comprising:

a first transistor in the output current path;

an operational amplifier having a negative input coupled to a first node receiving the input current, a positive input coupled to a drain of the first transistor at a second node, and an output coupled to a gate of the first transistor;

a basic circuit comprising:

a second transistor in the input current path, having a gate and a drain coupled together; and a third transistor in the output current path, having a gate coupled to the gate of the second transistor; and an auxiliary circuit in at least one of the input and output current path for improving a performance of the current mirror.

7. The current mirror circuit as claimed in claim 6, wherein the auxiliary circuit comprises at least a fourth transistor in the input current path and at least a fifth transistor in the output current path, and the second, third, fourth and fifth transistors are coupled to constitute a cascode structure.

8. The current mirror circuit as claimed in claim 7, wherein the fourth transistor has a gate and a drain coupled together, and the fifth transistor has a gate coupled to the gate of the fourth transistor.

9. The current mirror circuit as claimed in claim 6, wherein aspect ratios of the second transistor and the third transistor are substantially the same.

10. The current mirror circuit as claimed in claim 6, wherein the source and a bulk of the first transistor are coupled together.

11. The current mirror circuit as claimed in claim 6, wherein the first transistor is a P type transistor.

* * * * *